US009854929B1

(12) United States Patent
Anderson

(10) Patent No.: US 9,854,929 B1
(45) Date of Patent: Jan. 2, 2018

(54) FOOD DISPENSING TRAY ASSEMBLY

(71) Applicant: Lil Orbits, Inc., Champlin, MN (US)

(72) Inventor: Merritt Anderson, Champlin, MN (US)

(73) Assignee: Lil'Orbits, Inc., Champlin, MN (US)

( * ) Notice: Subject to any disclaimer, the term of this patent is extended or adjusted under 35 U.S.C. 154(b) by 207 days.

(21) Appl. No.: 14/838,504

(22) Filed: Aug. 28, 2015

Related U.S. Application Data

(60) Provisional application No. 62/043,615, filed on Aug. 29, 2014.

(51) Int. Cl.
*B65D 1/34* (2006.01)
*A47G 23/06* (2006.01)
*B65D 25/24* (2006.01)

(52) U.S. Cl.
CPC ..... *A47G 23/0633* (2013.01); *B65D 1/34* (2013.01); *B65D 25/24* (2013.01)

(58) Field of Classification Search
CPC ..... A47G 23/0633; B65D 1/34; B65D 25/02; A47J 47/01; A47J 47/14
USPC ..... 206/557; 119/161–170
See application file for complete search history.

(56) References Cited

U.S. PATENT DOCUMENTS

| | | | | |
|---|---|---|---|---|
| 1,886,958 | A | 11/1932 | Ittem | |
| 2,006,704 | A | 7/1935 | Muffling | |
| 2,271,822 | A | 2/1942 | Hills | |
| 4,802,609 | A | 2/1989 | Morse et al. | |
| 5,230,300 | A | 7/1993 | Mezhinsky | |
| 5,329,878 | A * | 7/1994 | McCauley | A01K 1/0107 119/165 |
| 5,329,879 | A * | 7/1994 | Walton | A01K 1/0107 119/165 |
| 5,381,729 | A | 1/1995 | Hennessey et al. | |
| 6,622,884 | B1 | 9/2003 | Gartner | |
| 7,152,754 | B2 | 12/2006 | Micciulla | |
| 8,087,535 | B1 | 1/2012 | Blum | |
| 8,132,531 | B1 | 3/2012 | Martin | |
| 8,573,118 | B2 | 11/2013 | Ewald et al. | |
| 2005/0263539 | A1 | 12/2005 | Haggerty et al. | |
| 2012/0234854 | A1 | 9/2012 | Bailey | |

* cited by examiner

*Primary Examiner* — J. Gregory Pickett
*Assistant Examiner* — James M Van Buskirk
(74) *Attorney, Agent, or Firm* — Haugen Law Firm PLLP

(57) ABSTRACT

A food tray is described that may be used to more easily remove food product from the tray. The device allows for emptying of the tray with the use of a removable ramp or spout that easily cleaned and coupled to the tray.

12 Claims, 7 Drawing Sheets

FOOD DISPENSING TRAY ASSEMBLY

CROSS-REFERENCE TO RELATED APPLICATIONS

The present application claims priority to provisional U.S. Patent Application Ser. No. 62/043,615 filed on Aug. 29, 2014, the application of which is incorporated herein by reference in its entirety.

FEDERAL SPONSORSHIP

Not Applicable

JOINT RESEARCH AGREEMENT

Not Applicable

TECHNICAL FIELD

This invention pertains generally to food containers and food dispensing trays. More particularly, the invention pertains to a food tray that may be used to more efficiently and quickly dispense food in uniform quantities while providing a tray assembly that is easily cleaned and stackable for storage.

BACKGROUND

Over the years various food containers have been devised to display food in an attractive manner while also providing a functional vessel to dispense food. At times it may be desirable to elevate the container to provide a heat source under the container while aesthetically displaying food within the container. A wire frame may be utilized to elevate the container a desired distance above the heat source. The container may be modified to couple in mating relation with the wire frame. At times, serving food from the container may require a separate ladle, however scooping food from the container may lead to inconsistent serving sizes and may also result in unintentional spills. Alternatively, containers with spouts have been devised, however when multiple containers are stacked for stowage, the containers require additional height to accommodate stacked containers.

SUMMARY

Embodiments according to aspects of the invention provide a food tray usable during the food production, display and dispensing of food product. Without limitation intended, the food tray of the present invention is particularly useful when making, displaying and dispensing mini donuts. The tray of the present invention includes a removable ramp that provides for efficient dispensing of food products into smaller point of sale containers including, for example, bags or buckets.

In accordance with aspects of the invention, an embodiment of the food dispensing tray assembly includes a tray and a removable ramp. Additionally, the assembly may include a wire frame stand or support to elevate the tray above a working surface. The tray includes a bottom, sides extending upward from the bottom and a lip extending outward from an upper end of the sides around a perimeter of an open top of the tray. Also, a cutout is formed in the tray to define a discontinuity in the lip and to provide an opening in a side of the tray for the ramp to couple to the tray. The removable ramp has a base, angled sides extending from edges of the base, interlocking rims that lock with an upper edge of the lip of the tray, and flanges extending between the base and the rim that engage inner walls of the tray adjacent the cutout in the side of the tray. A separation distance between the sides of the ramp is slightly less than a width of the cutout formed in the tray such that the ramp couples to the tray within the cutout in a mating relationship. A support extending outwardly from a bottom of the base of the ramp includes a groove in the support that engages a lower edge of the cutout of the tray.

Additionally, in accordance with aspects of the invention the food dispensing tray assembly may include a tray, removable ramp, and support. The tray includes a bottom, sides extending upward from the bottom and a lip extending outward from an upper end of the sides around a perimeter of an open top of the tray, wherein a cutout is formed in the tray defining a discontinuity in the lip. The removable ramp has a base, angled sides extending from edges of the base, interlocking rims that lock with an upper edge of the lip of the tray, and flanges extending between the base and the rim that engage inner walls of the tray adjacent the cutout in the side of the tray. A separation distance between the sides of the ramp is slightly less than a width of the cutout formed in the tray to provide a desired fit between the ramp and tray. A support extending outwardly from a bottom of the base of the ramp includes a groove in the support that engages a lower edge of the cutout of the tray. A wire frame or stand may be further incorporated into the assembly to elevate the tray and ramp above a working surface.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

A food dispensing tray assembly 10 particularly well suited for point of sale production, display and dispensing of food stuffs, includes a wire stand or frame 14, tray 16 and detachable ramp or chute 18. The ramp is particularly well suited to re-direct food stuff from the tray into point of sale bags, buckets, or other point of sale containers. Additionally, the ramp is easily removed to clean the ramp prior to stowage.

Figure 1:
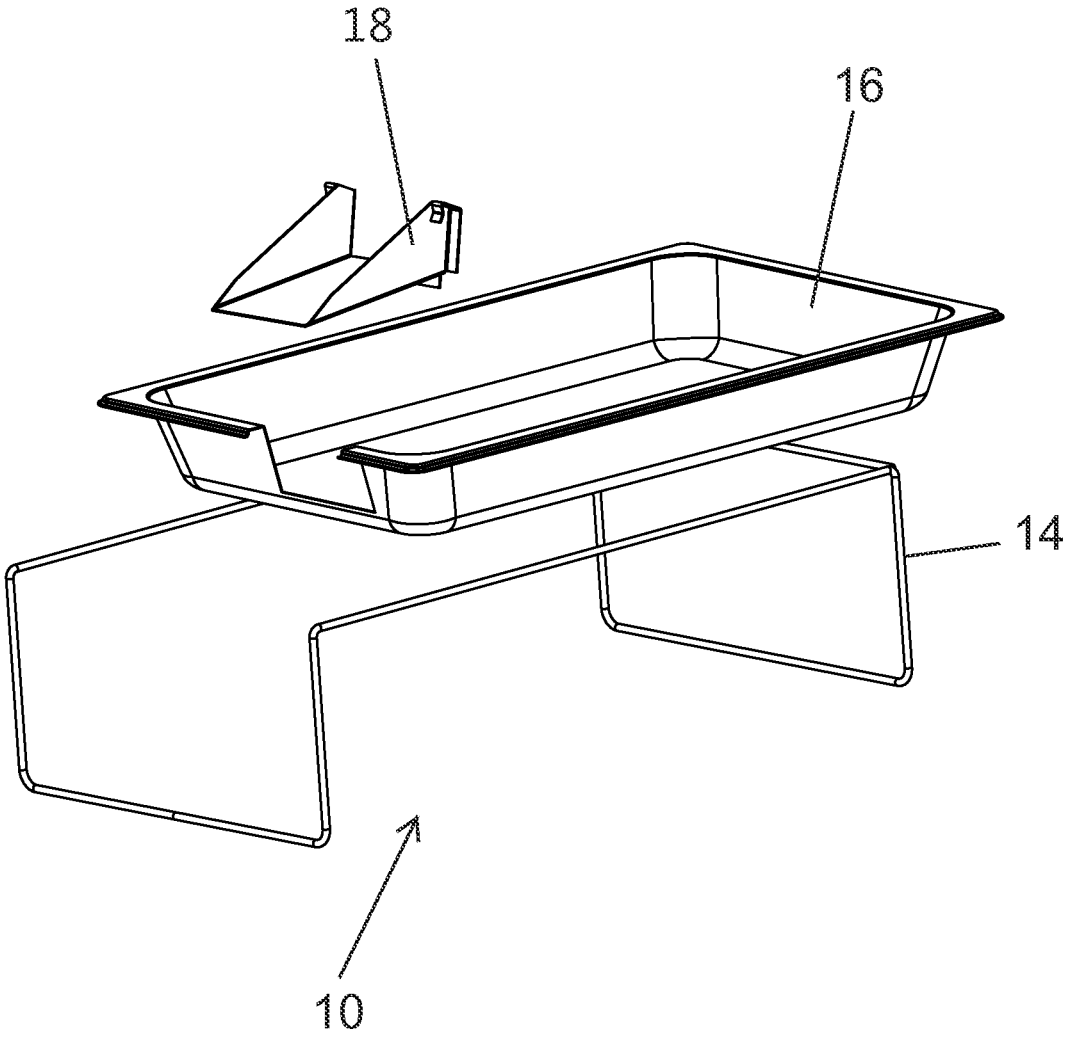
FIG. 1 is an exploded perspective view of a tray and ramp in accordance with an embodiment of the invention elevated above a wire frame.
Figure 2:
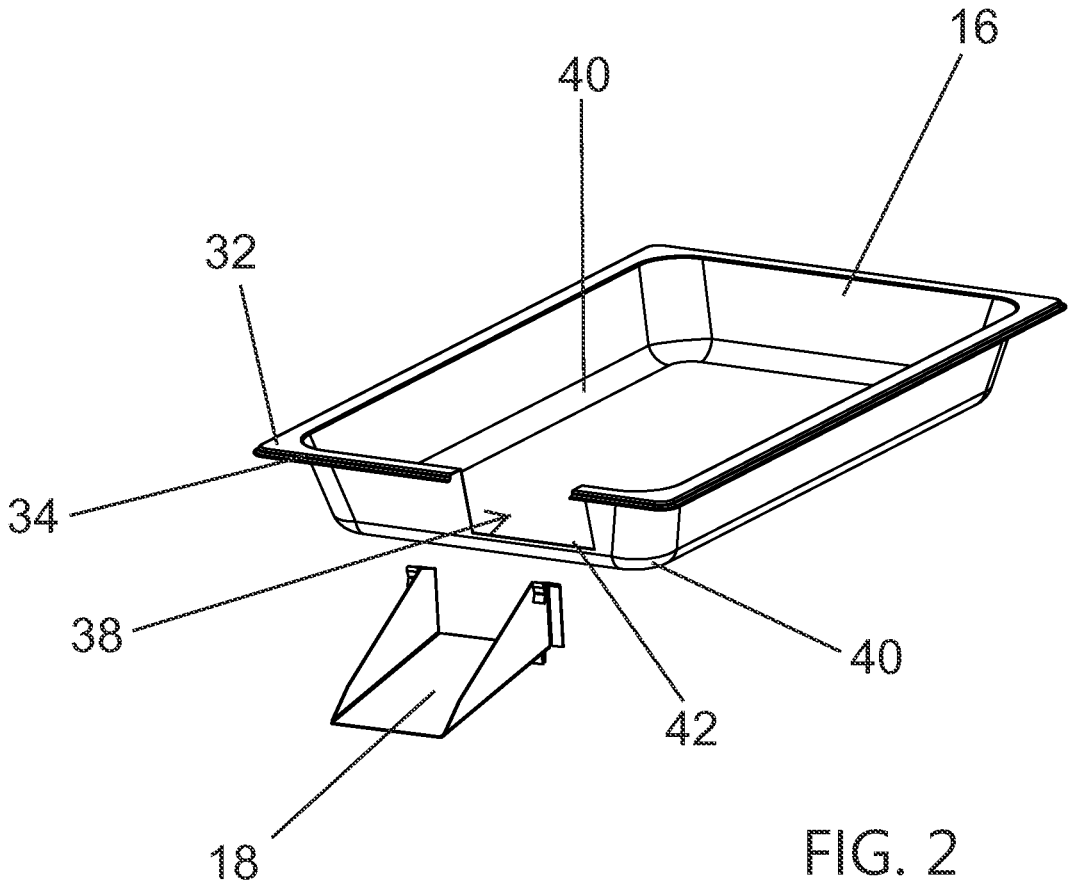
FIG. 2 is a perspective view of the ramp elevated above the tray and having the ramp removed in accordance with an embodiment of the invention.
Figure 3:
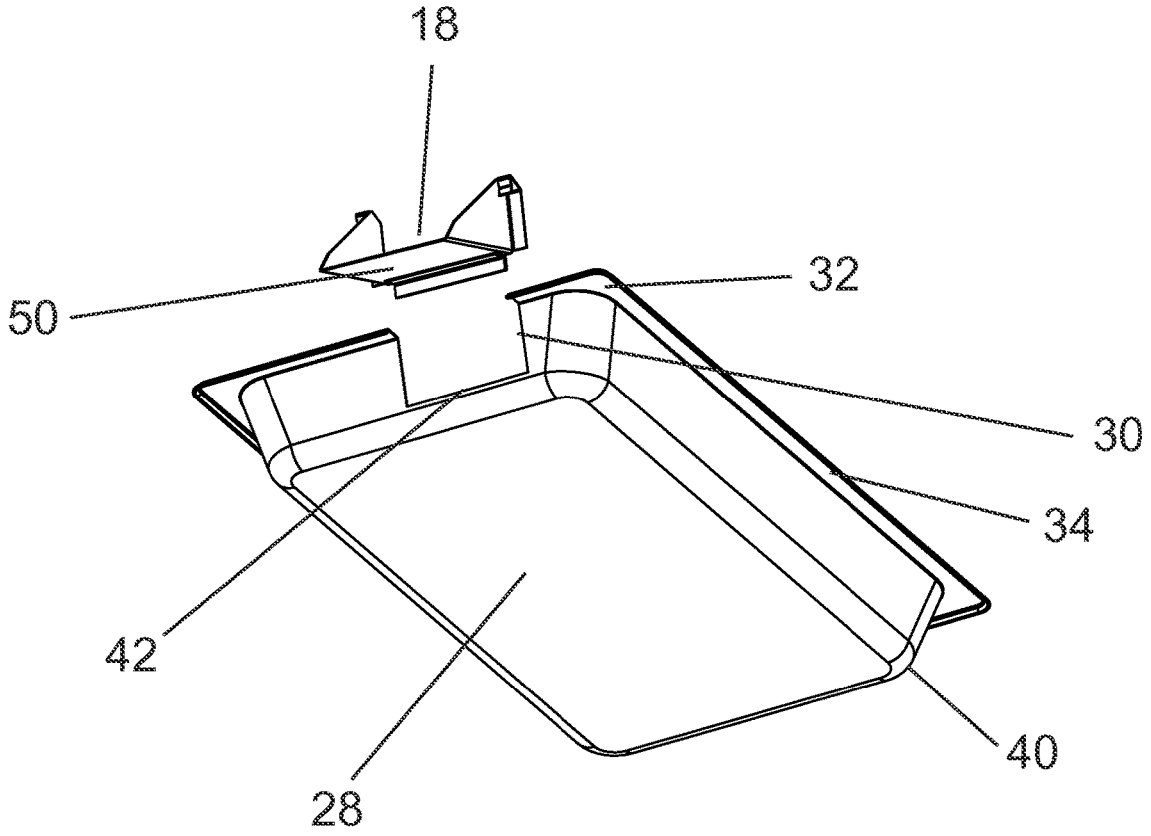
FIG. 3 is a bottom end perspective view of the tray illustrating the cutout and having the ramp or chute removed.
Figure 4:
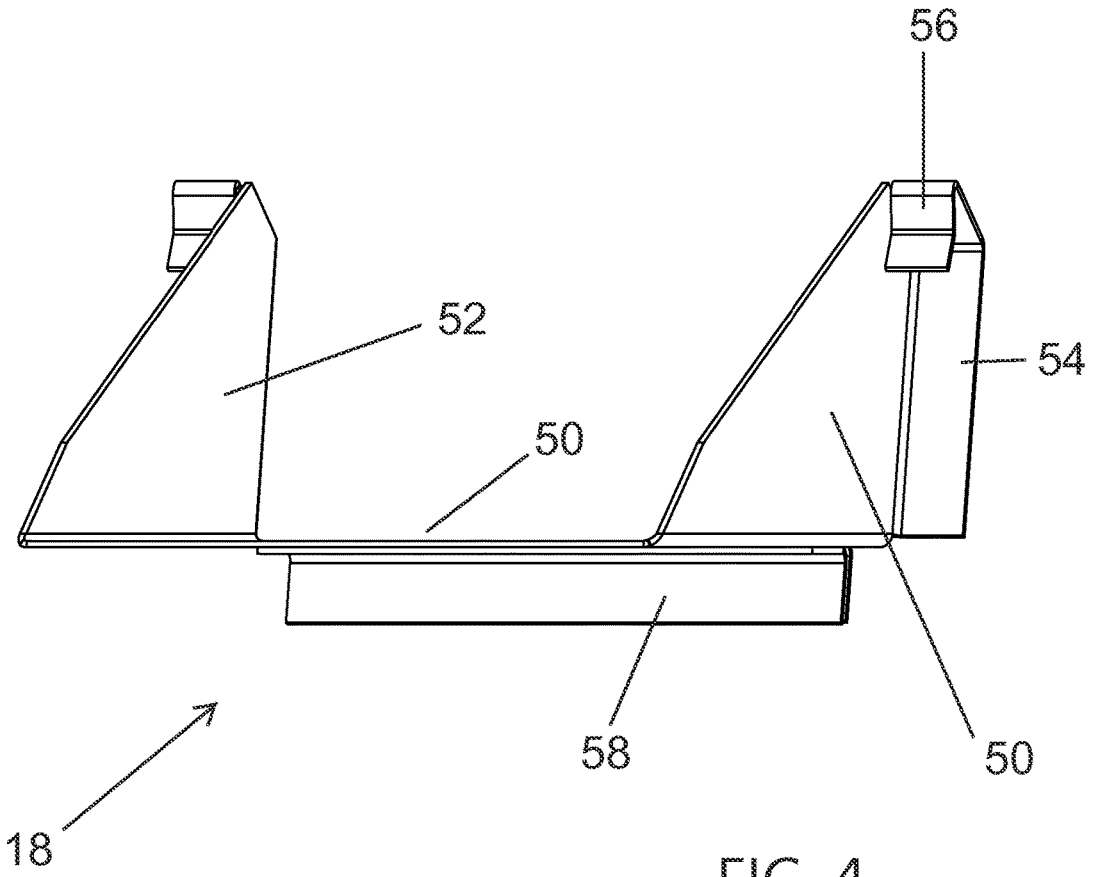
FIG. 4 is a front right perspective view of the ramp in accordance with an embodiment of the invention.
Figure 5:
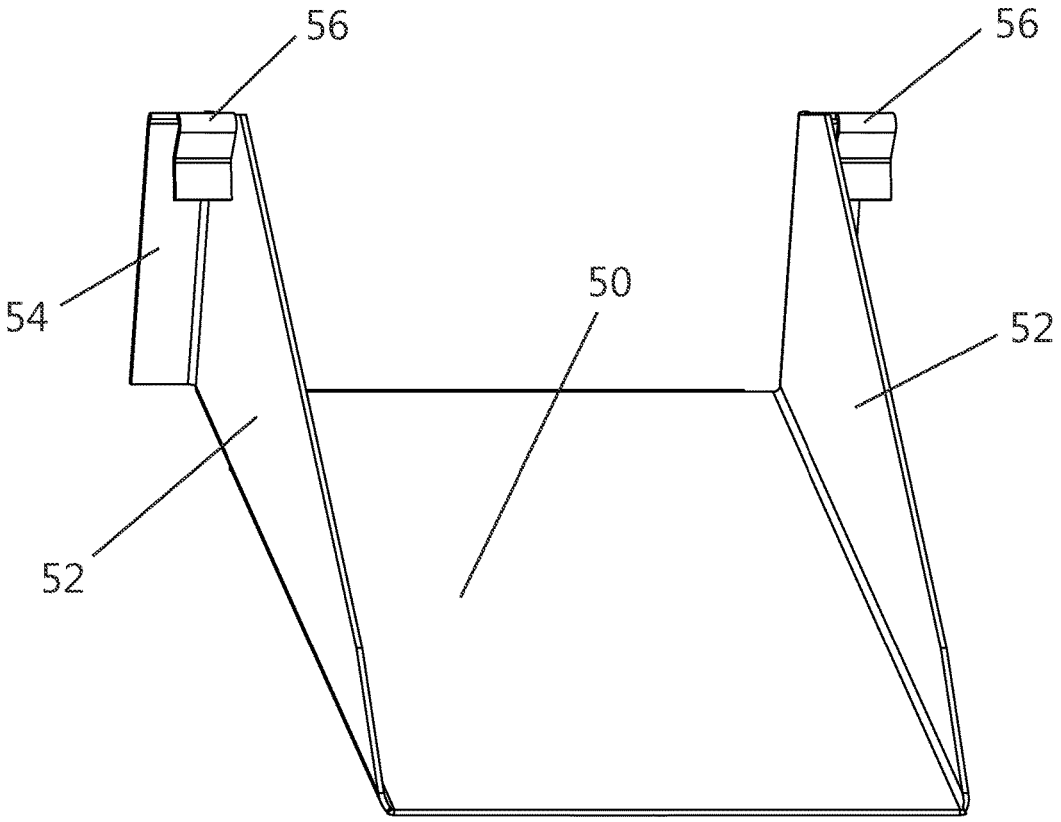
FIG. 5 is a front left perspective view of the ramp of the type shown in FIG. 4 and in accordance with an embodiment of the invention.
Figure 6:
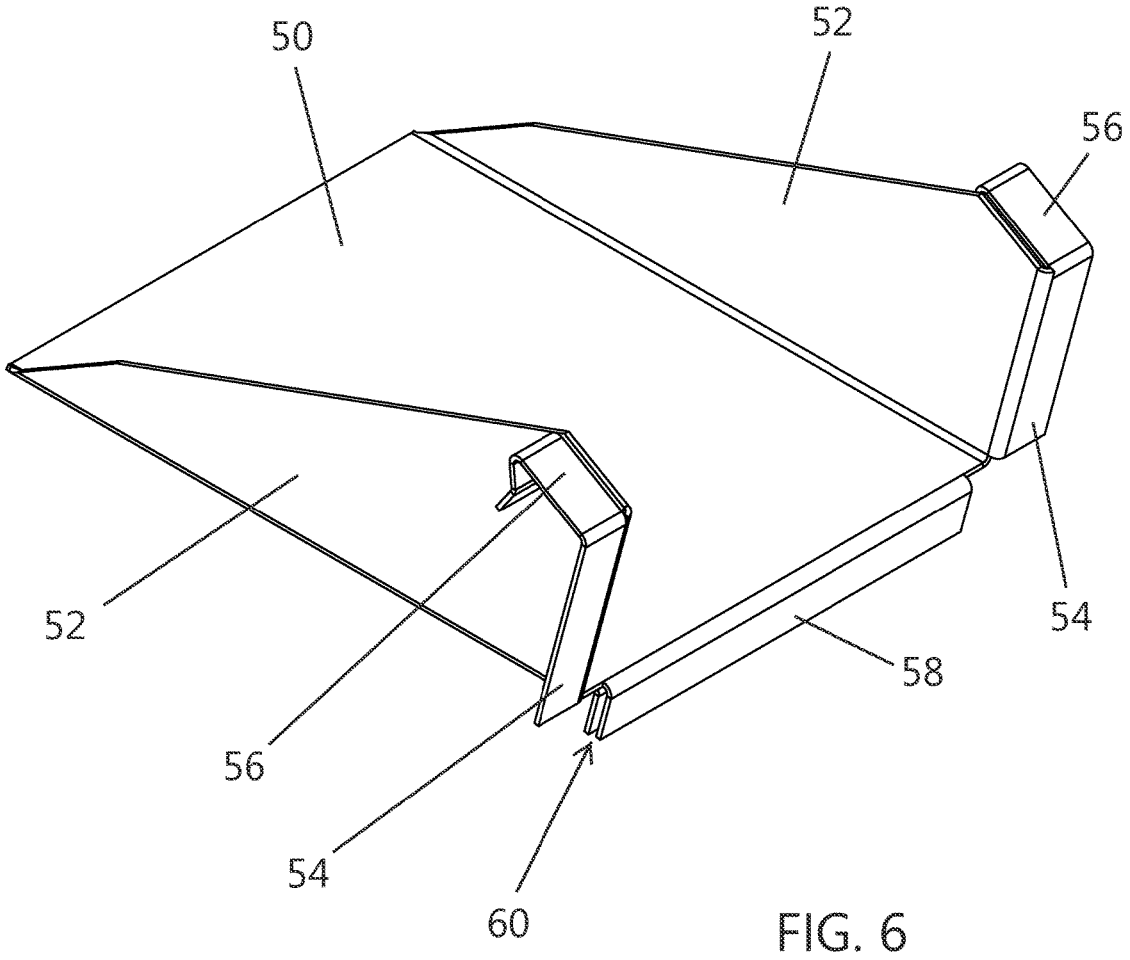
FIG. 6 is a back perspective view of the ramp of the type shown in FIG. 4.
Figure 7:
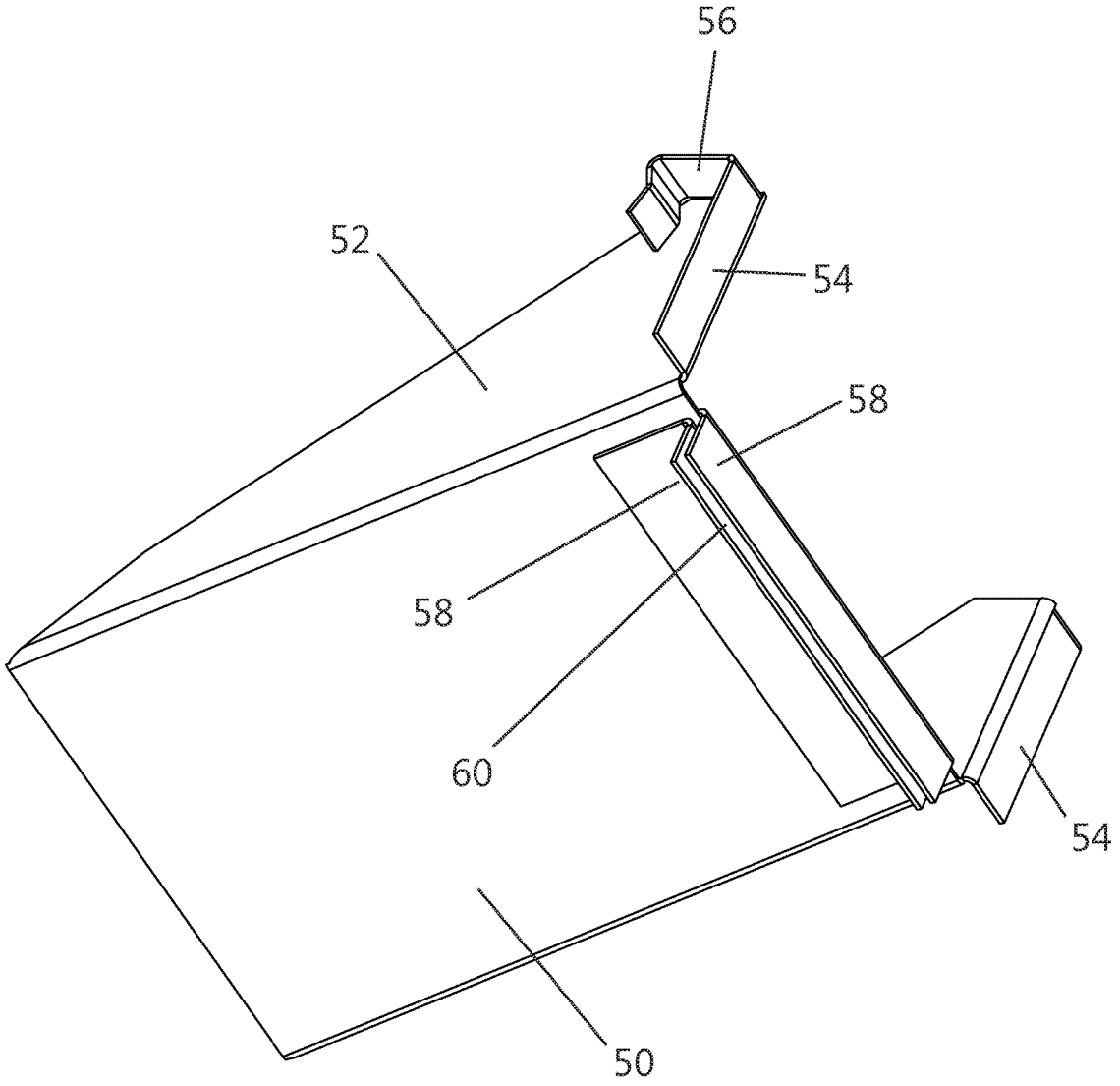
FIG. 7 is a bottom back perspective view of the ramp of the type shown in FIG. 4.

With reference to FIGS. 1-3, the tray 16 includes a bottom 28, discontinuous sides 30 extending upward from the bottom 28, a lip 34 extending outward from an upper end of the sides 30. A rim 32 extends downward from an outer end of the lip 34. The lip 34 extends around a perimeter of an open top of the tray 16. A cutout or void 38 is formed in an end side of the tray 16, defining a discontinuity in the sides 30 and lip 34. The cutout 38 of the tray 16 extends from the lip 34 downward to a curved intersecting portion 40 of the bottom 28 and sides 30 of the tray 16. The sides 30 of the tray 16 slope outward from the bottom 28 of the tray to reduce the amount of food particles retained on the sides 30.

With reference to FIGS. 4-7, the removable ramp or food chute 18 includes a base 50, angled sides 52 extending from edges of the base 50, and interlocking curved clips or fingers 56 that lock with an upper edge of the lip 34 and rim 32 of the tray 16. Flanges 54 extend between the base 50 and the clip 56 and is dimensioned to engage an inner side wall of the tray 16 adjacent the cutout 38 in the side 30 of the tray 16. A separation distance between the sides 52 of the ramp 18 is slightly less than a width of the cutout 38 formed in the tray 16. A support 58 extends outwardly from a bottom of the base 50 of the ramp 18, wherein a groove 60 in the support 58 engages a lower edge 42 of the cutout 38 of the tray 16. The lower edge 42 of the cutout engages in the groove to further retain the ramp 18 in a fixed position relative to the tray. The flange 54 extends from the base 50 forming an angle between the base 50 and the flange 54, the angle being obtuse.

Use of the food dispensing tray assembly 10 will next be described in conjunction with the production, sale and dispensing of mini donuts. Those skilled in the art will appreciate that other food stuffs may be equally dispensed efficiently from the tray 16 of the present invention. During the production of mini donuts a donut machine ejects fried donuts into the tray 16, where the donuts may be sugared or otherwise coated while they cool. Donuts are easily dispensed from the tray by pushing or sliding the donuts on to ramp 18. A bag or bucket may be placed under the ramp to collect the desired number of donuts to be sold. When the tray is empty and cleanup is required, the ramp 18 is detached from the lip 34 of the tray 16 and quickly cleaned. Multiple trays 16 may be stacked together and multiple ramps 18 may be stowed in the open tray portion of the upper most tray of stacked trays.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A food dispensing tray assembly comprising:

a food tray having a bottom, sides extending upward from the bottom and a lip extending outward from an upper end of said sides around a perimeter of an open top of said tray, wherein a cutout is formed in said tray defining a discontinuity in said lip;

a removable ramp having a base, angled sides extending from edges of said base, interlocking clips that lock with an upper edge of the lip of said tray, and flanges extending between the base and the interlocking clips, wherein said flanges engage inner walls of said tray adjacent the cutout in the side of said tray, further wherein a separation distance between the sides of said ramp is slightly less than a width of the cutout formed in said tray.

2. The tray assembly as recited in claim 1, further including a support extending outwardly from a bottom of the base of the ramp, wherein a groove in said support engages a lower edge of the cutout of the tray.

3. The tray assembly as recited in claim 1, wherein the cutout of the tray extends from the lip to a curved portion of the bottom of the tray.

4. The tray assembly as recited in claim 1, wherein the sides of said tray slope outward from the bottom of said tray.

5. The tray assembly as recited in claim 1, wherein said flange extends from said base forming an angle between said base and said flange, said angle being obtuse.

6. A food dispensing tray assembly comprising:

a tray having a bottom, sides extending upward from the bottom and a lip extending outward from an upper end of said sides around a perimeter of an open top of said tray, wherein a cutout is formed in said tray defining a discontinuity in said lip;

a removable ramp having a base, angled sides extending upward from edges of said base, interlocking clips that lock with an upper edge of the lip of said tray, and flanges extending between the base and the interlocking clips, wherein the flanges engage inner walls of said tray adjacent the cutout in the side of said tray, further wherein a separation distance between the sides of said ramp is slightly less than a width of the cutout formed in said tray; and a support extending outwardly from a bottom of the base of the ramp, wherein a groove in said support engages a lower edge of the cutout of the tray.

7. The tray assembly as recited in claim 6, wherein the cutout of the tray extends from the lip to a curved portion of the bottom of the tray.

8. The tray assembly as recited in claim 6, the sides of said tray slope outward from the bottom of said tray.

9. The tray assembly as recited in claim 6, wherein said flange extends from said base forming an angle between said base and said flange, said angle being obtuse.

10. A food dispensing tray assembly comprising:

a tray having a bottom, sides extending upward from the bottom and a lip extending outward from an upper end of said sides around a perimeter of an open top of said tray, wherein a cutout is formed in said tray defining a discontinuity in said lip;

a removable food chute having a base, angled sides extending upward from edges of said base, interlocking clips that lock with an upper edge of the lip and rim of said tray, and flanges extending between the food chute and the interlocking clips, wherein said flanges engage inner walls of said tray adjacent the cutout in the side of said tray, and wherein a separation distance between the sides of said food chute is slightly less than a width of the cutout formed in said tray, and wherein said flange extends from said base forming an angle between said base and said flange, said angle being obtuse; and a support extending outwardly from a bottom of the base of the food chute, wherein a groove in said support engages a lower edge of the cutout of the tray.

11. The tray assembly as recited in claim 10, wherein the cutout of the tray extends from the lip to a curved portion of the bottom of the tray.

12. The tray assembly as recited in claim 10, the sides of said tray slope outward from the bottom of said tray.

* * * * *